United States Patent [19]

Tokura et al.

[11] 4,272,601

[45] Jun. 9, 1981

[54] COATED DEVELOPER CARRIER FOR ELECTROPHOTOGRAPHY

[75] Inventors: Hiroshi Tokura; Keiji Sato; Makoto Tomono, all of Hachioji; Sadatugu Terada; Hideaki Arai, both of Hino, all of Japan

[73] Assignee: Konishiroku Photo Industry Co., Ltd., Tokyo, Japan

[21] Appl. No.: 43,760

[22] Filed: May 30, 1979

[30] Foreign Application Priority Data

Jun. 6, 1978 [JP] Japan ..... 53-67249
Jun. 6, 1978 [JP] Japan ..... 53-67250

[51] Int. Cl.[3] ..... G03G 9/10

[52] U.S. Cl. ..... 430/108; 430/137; 428/403; 428/404; 428/406; 428/407

[58] Field of Search ..... 430/110, 115, 108, 137; 428/404, 406, 407, 403

[56] References Cited

U.S. PATENT DOCUMENTS

| | | | |
|---|---|---|---|
| 2,874,063 | 2/1959 | Greig | 430/120 X |
| 3,473,923 | 10/1969 | Ohkubo et al. | 430/107 X |
| 3,809,554 | 5/1974 | Merrill et al. | 430/120 X |
| 3,850,642 | 11/1974 | Bailey, Jr. et al. | 430/529 |
| 4,113,641 | 9/1978 | Brana et al. | 430/108 |

*Primary Examiner*—John D. Welsh
*Attorney, Agent, or Firm*—Bierman & Bierman

[57] ABSTRACT

Disclosed are carrier compositions for electrophotographic developers comprising core particles coated with a mixture of a resin and an organic surfactant having at least one carbon-fluorine bond and at least one functional group having an affinity for the resin. An intermediate resin layer may be present on the core particles, which themselves may be metal, glass or silicon dioxide, e.g.

15 Claims, 1 Drawing Figure

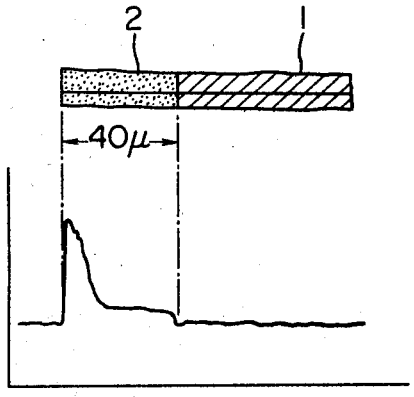
2
1
40μ

COATED DEVELOPER CARRIER FOR ELECTROPHOTOGRAPHY

This invention relates to a developer carrier for electrophotography, particularly to the developer carrier which is contained, together with a toner, in a developer for electrophotography.

In the electrophotographic process, a photosensitive element (a photoconductive element) is given a uniform surface charge in a dark place, followed by the formation of an electrostatic latent image as a result of an imagewise exposure, and then the thus formed latent image is developed with a developer to form a visible image.

Development procedures of such electrostatic latent images are roughly classified as of a liquid development process and a dry development process. The liquid development process relies on the use of a liquid developer prepared by dispersing fine particles of a variety of pigments or dyes in an insulating organic liquid. On the other hand, the dry development process relies on the use of charged particles known commonly as toner, which particles are prepared by dispersing coloring materials such as carbon black and the like in particulate natural or synthetic resins so that the coloring materials are contained in the particulate resins. In this dry development process, there are such techniques as a hair brushing method, impression method and a powder cloud method wherein only the aforesaid toner is used and, in addition thereto, the so-called magnetic brush method and cascade method wherein a mixture of a carrier consisting of iron powder or glass beads and the aforesaid toner is used as a developer.

According to the above-mentioned development procedures, charged particles such as charged toner particles contained in the developer adhere to the electrostatic latent image as formed on the imagewise exposed photosensitive element to form a visible image. The thus formed visible image is fixed by application thereto of heat, pressure or solvent vapor, onto the photosensitive element, or alternatively said image is transferred onto the other image-recording support such as paper and the like and then fixed likewise.

THE DRAWING

The FIGURE depicts the thickness of the coating layer of resin and surfactant 2, and an X-ray spectrum thereof.

The present invention is concerned with a developer carrier advantageously used in the magnetic brush and cascade methods mentioned-above among the development procedures. That is, the invention relates to a developer carrier for imparting a desired charge to a toner by being stirred together with the toner.

Generally, carriers of the above kind may be roughly classified as of the conductive carrier and insulating carrier. As the conductive carrier, there is usually used oxidized or unoxidized iron powder. In the developer comprising this iron powder as its ingredient, however, there are observed such drawbacks that triboelectric charge characteristics relative to the toner is unstable and fogs are formed on the visible image formed by said developer. That is, in progress of using the developer, because the toner particle adheres to the surface of the iron powder carrier, electric resistance of the carrier particle increases, whereby bias current lowers and, moreover, triboelectric charge characteristics becomes unstable, with the result that the resulting visible image decreases in image density and increases in the fog. Accordingly, the use in a continuous electrophotographic copying machine of a developer containing an iron powder carrier results in deterioration of the developer even after a small number of repetitions of the copying and, therefore, the developer thus deteriorated requires replacement from time to time and costs dearly in the long run.

Typical of the insulating carrier, on the other hand, are those which have been prepared by uniformly coating the surfaces of core particles consisting generally of such ferromagnetic body such as iron, nickel, ferrite or the like with an insulating resin. The advantages of developers comprising a carrier containing this type of ingredient are: they suffer less markedly from adherence to the surface of a toner particle than developers comprising the conductive particle; it is easy to simultaneously control the triboelectric charge characteristics of both the toner and the carrier; and its excellent durability makes it particularly suitable for high speed electrographic copying machines.

The above-mentioned insulating carriers require that the materials which are used to coat the surfaces of the core particles of the carrier must have sufficient wear-resistance, favorable adhesion force to the core particles, favorable properties of preventing the toner particles from adhering to the carrier surface so that no toner filming is formed on the surfaces of the core particles, and charge characteristics such that a charged state with desired largeness and polarity can be attained by the action of friction between the core particles of the carrier and particles of specific toner used in combination therewith.

That is, in an insulating carrier, particles are rubbed with other insulating carrier particles, toner particles and the inner wall of the container. In that case, however, when the material coated on the surfaces of the carrier particles wears out owing to the friction as aforesaid, the charge characteristics attained by the action of said friction comes to lose in stability and eventually the imparting of a desired charged state to the toner particles is impossible. Even though the coating material on the core particles of carrier is sufficiently wear-resistant, when adhesion force of said material to the core particles is small, the coating material peels off or is triturated owing to the action of friction as aforesaid, whereupon the charge characteristics come to be lost likewise. Further, the charge characteristics become unstable, as well, when the toner particles adhere to the surface of the coating material and form thereon coatings thereof. In either case as mentioned above, the entire developer requires replacement at an early stage. Furthermore, the largeness and polarity of frictional charge produced on the toner are controlled by the largeness and polarity of the charge of the carrier, and hence in order to impart a desired charged state to the toner, the carrier should naturally have such charge characteristics as capable of satisfying the purpose.

A variety of insulating carriers have heretofore been proposed, but none of them has been found to be capable of fulfilling all the requirements mentioned above. For instance, it is known that resins commonly used as materials for coating the surfaces of core particles cannot prevent the formation of the aforesaid toner coatings because such resins have large surface energies. On the other hand, fluorine-containing resins with low surface energies, such as teflon and the like, have other drawbacks. Their low adhesivity prevents sufficient adherence of the resin to the core particle; these teflon resins are insoluble in most solvents; therefore, the coating process is complex, and, also, the heat treatment process thereof.

Further, it has been proposed to treat the surfaces of the core particles of the carrier with fluorine-containing surface active agents. However, the resulting core particles are poor in wear-resistance, quite unstable in triboelectric charge characteristics, and markedly inferior in durability. It has been also proposed that the fluorine-containing surface active agents be coated on the surfaces of the core particles of the carrier with resin layers. As compared with carriers having no resin layer thereon, the carriers as prepared in the above manner are relatively stable in the initial triboelectric charge characteristics, but are markedly poor in durability, as well. Thus, the carriers of the above type have no practical use at all.

In the light of the foregoing points, an object of the present invention is to provide carriers for the development of electrostatic latent images which are highly durable and, also, have stable triboelectric charge characteristics.

A further object of the invention is to provide a developer carrier for electrophotography, in which the coating material used has a sufficiently strong adhesion force to a core particle of the carrier and will not mechanically destroyed to peel off from the core particle and which in this light has stable triboelectric charge characteristics.

Another object of the invention is to provide a developer for electrophotography in which the carrier are coated with coating layers with small surface energy and which are sufficiently capable of preventing the formation of toner filming on the core particles.

A still further object of the invention is to provide a developer for electrophotography, which can be prepared by a very easy procedure and which have an excellent durability and are quite inexpensive.

For accomplishing the above-mentioned objects, the surfaces of core particles for the carrier are coated in the present invention with coating layers comprising a resin and a surface active agent containing therein a carbon-fluorine bond or bonds, said agent having been incorporated into said resin.

In the carriers according to the present invention as explained hereinbefore, by the aid of the resins constituting the coating layers, said layers not only adhere to the core particles by a large adhesion force but also are mechanically tough and, moreover, because of the surface active agents having carbon-fluorine bonds, and having been incorporated into said resins, surface energy of the coating layers become small, whereby adherence to the surface of the carrier for toner particles can be prevented and practically no formation of toner filming is observed and, at the same time, frictional force of the carriers can be appropriately lessened. In consequence of the above points, the carrier of present invention are free from wear, rupture and peeling-off of the coating layer and also from change in surface characteristics due to adherence to the carrier surface of foreign matter. Thus, the carrier of present invention are stable without losing their excellent triboelectric charge characteristics even when used for a prolonged period of time and consequently can always fulfill the expected duties thereof and come to have an excellent durability. In the development of electrostatic latent images with a developer consisting of the carrier and toner according to the present invention, on that account, the carrier can impart over a long period of time an electric charge having desired largeness and polarity to the toner particles, thereby forming a large number of copies of the images excellent in image quality and free from fog.

In the present invention there is no need for a separate fluorine-containing surface active agent because the agent is incorporated into the resin. Consequently, coatings can be readily applied to the core particles of the carrier with a solution prepared by dissolving the resin and the surface active agent in a solvent compatible therewith.

Preferable surface active agent is a compound containing a functional group compatible with the resin of said coating layer.

Preferable as the functional group mentioned above is —COOR, —OR, —NCO, $—N(R)_2$, $—N^+(R)_3$, $—CON(R)_2$, —SR, $—OSO_3R$ or $—SO_3R$ (wherein R represents hydrogen, or an alkyl group, an aryl group, an aralkyl group, an alkaryl group, a heterocyclic ring, an alkenyl group or salts of derivative of these group). Such functional groups generally have large chemical affinity or physical affinity for a variety of resins, and accordingly the surface active agents containing these functional groups are strongly retained in the resins. Usable as the surface active agents in the present invention are $C_4F_9COOH$, $C_7F_{15}SO_3Na$, $C_8F_{17}OCH_3$, $C_4F_9NCO$, $CF_3SO_3C_2H_3$, $C_7F_{15}COOH$, $C_7F_{15}CONH_2$, $C_4F_9SO_3NH_4$, $C_{16}F_{21}SNa$, etc. However, compounds represented by the general formulas (I) to (V) are also suitably usable.

General formula (I)

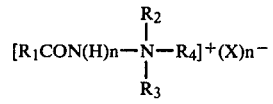

General formula (II)

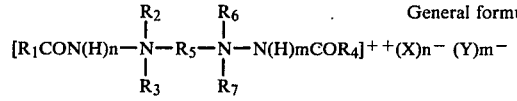

General formula (III)

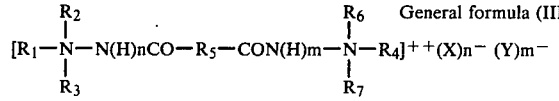

General formula (IV)

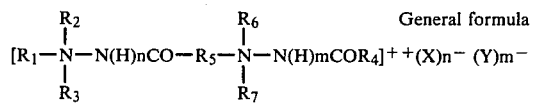

wherein $R_1$ and $R_4$ represent an alkyl group, an aralkyl group, an aryl group, a heterocyclic ring or a group derived therefrom and at least one of $R_1$ and $R_4$ represents said group or ring, of which the whole or part of hydrogen atoms has been substituted by fluorine atoms; $R_2$, $R_3$, $R_6$ and $R_7$ each represent a lower alkyl group (preferably as the alkyl group having 1-4 carbon atoms); $R_5$ represents a divalent group (the preferable as the divalent group are an alkylene group, an arylene group, an alkenylene group, an oxyalkylene group, an alkyleneoxyalkylene group, a polyoxyalkylene group or a divalent group combined with at least one of an alkylene group and at least one of an arylene group.); $(X)^-$ and $(Y)^-$ individually represent an anion [the preferable as the aninon are a halogen anion (e.g. chlorine, bromine or iodine), a perchlorate anion, a sulfonate anion, a sulfate anion, a nitrate anion, or a carboxylate anion], (I-1)

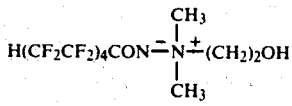

(I-3)

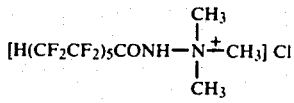

(I-5)

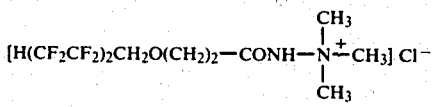

(I-7)

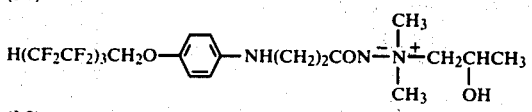

(I-9)

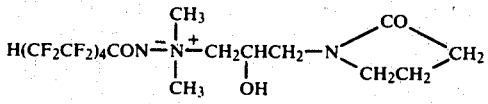

(I-11)

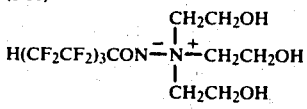

X and Y may be the same; and m and n individually represent 0 or 1.

General formula (V)

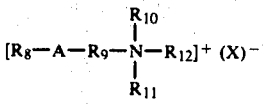

wherein $R_8$ represents a group having at least 3 carbon atoms and at least 3 fluorine atoms attached to the carbon atoms; A represents a divalent atom or a divalent group [preferable as the atom or the group are —O—, —S—, —NR'—, —$SO_2$NR'—, —CONR'—, —NR'$SO_2$—, —NR'CO—, —$SO_3$—, —$OSO_3$—, —CO—, —COO— or —OCO— (wherein R' represents an alkyl group (preferable an alkyl group is the group having 1-6 carbon atoms) or an aryl group)]; $R_9$ represents a divalent hydrocarbon group (preferable as the divalent hydrocarbon group are an alkylene group, an alkenylene group, an arylene group, an aralkylene group, an alkarylene group, an oxyalkylene group, an oxyarylene group or a polyoxyalkylene group.); $R_{10}$, $R_{11}$ and $R_{12}$ represent an alkyl group having 1-6 carbon atoms, an aryl group or an aralkyl group, and $R_{10}$ and $R_{12}$, or $R_{10}$, $R_{11}$ and $R_{12}$ can be from a 5- or 6- membered nitrogen containing heteracyclic ring together with nitrogen atom; and $(X)^-$ represents an anion (aforementioned).

These groups and a ring can be contained the substituents or substituent such as a halogen (e.g. chlorine, bromide), a hydroxy group, a carboxy group, a sulfo group, a nitro group, a sulfate group, an alkyl group, an alkenyl group, an aryl group, an amido group, a carbamoyl group, a sulfonamido group or a sulfamoyl group.

Typical examples of the compound represented by the aforesaid general formula (I) include those mentioned below.

(I-2)

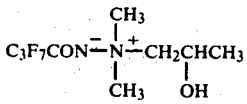

(I-4)

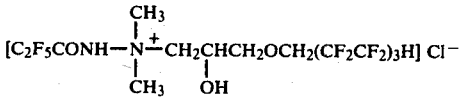

(I-6)

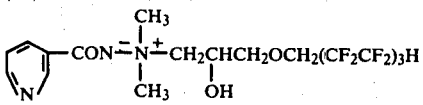

(I-8)

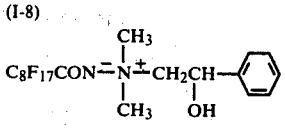

(I-10)

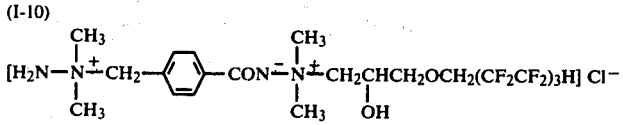

(I-12)

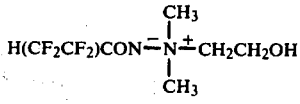

Typical examples of the compound represented by the aforesaid general formula (II) include those mentioned below.

(II-1)

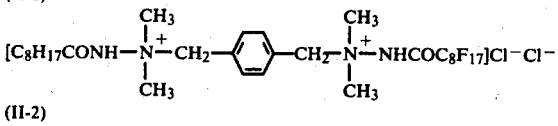

(II-2)

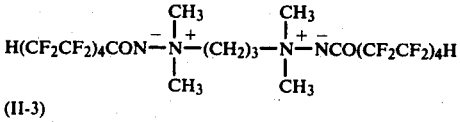

(II-3)

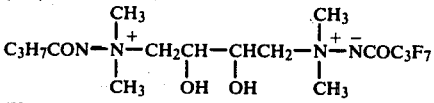

(II-4)

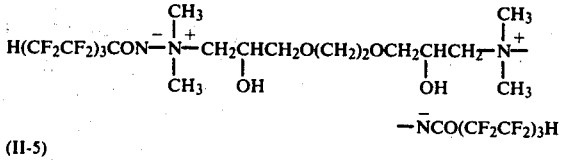

(II-5)

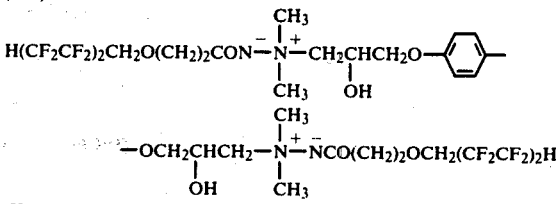

(II-6)

-continued
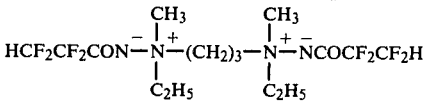
(II-7)
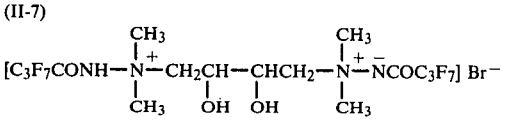
(II-1)
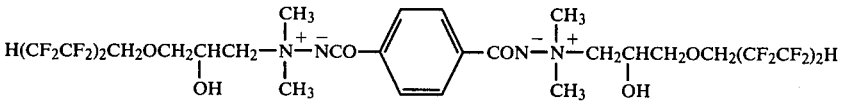
(II-2)
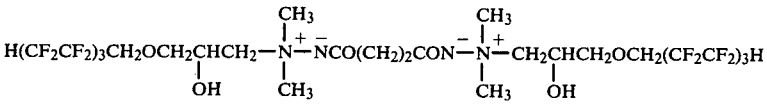
(II-3)
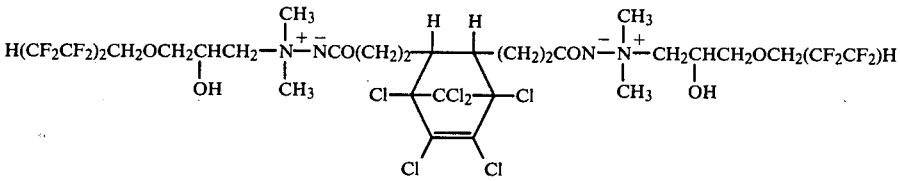
(II-4)
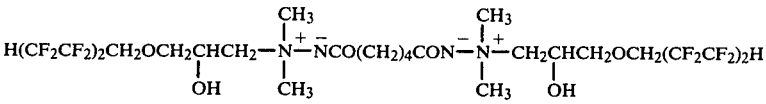
(II-5)
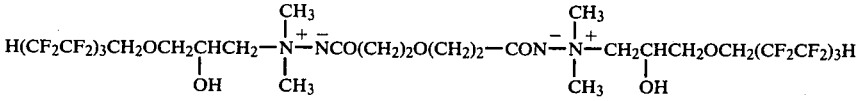
(II-6)
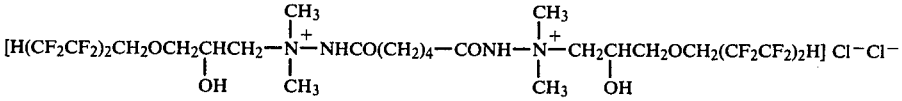
(II-8)
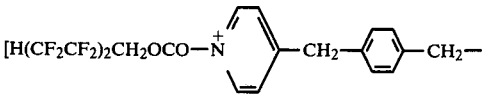
-continued
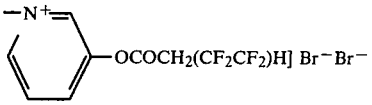
Typical examples of the compound represented by the aforesaid general formula (III) include those mentioned below.
Typical examples of the compound represented by the aforesaid general formula (IV) include those mentioned below.
(IV-1)
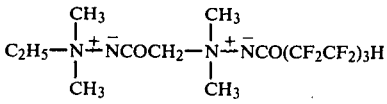
(IV-2)
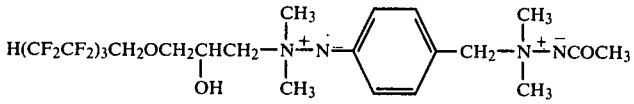
(IV-3)
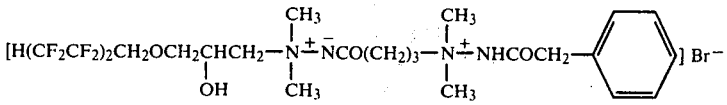
(IV-4)

-continued

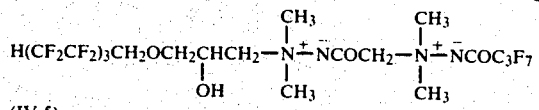

(IV-5)

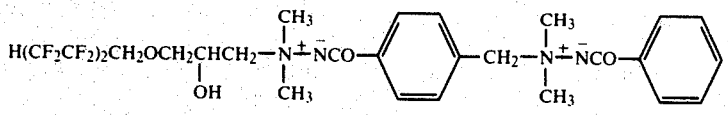

Typical examples of the compound represented by the aforesaid general formula (V) include those mentioned below.

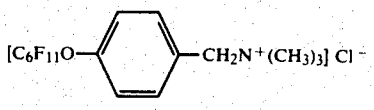

(V-1)

$[C_{12}F_{23}O(CH_2CH_2O)_3CH_2CH_2N^+(CH_3)_3]\ I^-$ (V-2)

$[C_8F_{17}SO_2NH(CH_2)_3-N^+(CH_3)_3]\ I^-$ (V-3)

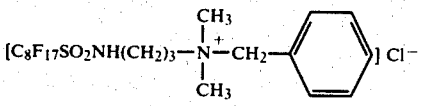

(V-4)

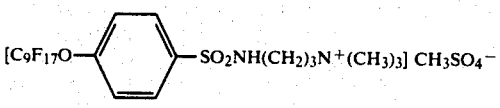

(V-5)

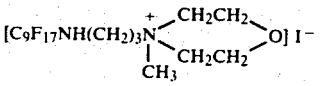

(V-6)

$[C_9F_{17}O(CH_2)_3N^+(CH_3)_3]\ I^-$ (V-7)

$[C_9F_{17}N(CH_2)_3N^+(CH_3)_2]\ Br^-$ (V-8)
$\quad\quad\ \ CH_3 \quad\ C_2H_5$ $[C_7F_{15}CONH(CH_2)_3N^+(CH_3)_3]\ Cl^-$ (V-9)

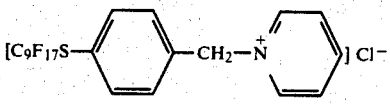

(V-10)

$[C_7F_{15}COO(CH_2)_3N^+(CH_3)_3]\ CH_3SO_4^-$ (V-11)

$[C_8F_{17}SO_3(CH_2)_3N^+(C_2H_5)_2]\ I^-$ (V-12)
$\quad\quad\quad\quad\quad CH_3$ Surface active agents for the present invention can be synthesized according to the procedure, per se, known, and these compounds can also be converted readily according to the usual method into acylhydrazinium salts by treatment with hydrochloric acid, hydrobromic acid, hydroiodic acid, perchloric acid, etc.

Preferable synthesis examples of these compounds are given as follows:

SYNTHESIS EXAMPLE 1

Preparation of exemplified compound (I - 1)

To a pressure bottle charged with 45 cc of isopropyl alcohol were added 1.9 g of ethylene oxide, 2.5 g of N,N-dimethylhydrazine and 20 g of $H(CF_2CF_2)_4COOC_2H_5$, and the bottle was sealed and then allowed to stand at room temperature for 5 days. After completion of the reaction, the isopropyl alcohol was removed under reduced pressure, followed by recrystallization with benzene to obtain the tittle compound as white crystals. The compound thus obtained was found to have a melting point of 48°-50° C., and the yield was 17.5 g 78.2% yield).

SYNTHESIS EXAMPLE 2

Preparation of exemplified compound (II - 2)

Into an anhydrous ether were added 60 g of dimethylhydrazine and 202 g of 1,3-trimethylene dibromide, and the mixture was allowed to stand at room temperature to undergo reaction. After the reaction, deposited crystals were collect by filtration, washed with ether and then dried to obtain 258 g of white crystals.

After boiling 13.1 g of 1,3-trimethylenebis-N,N-dimethylhydrazinium bromide with 47.4 g of $H(CF_2CF_2)_4COOC_2H_5$ and 5.4 g of sodium methoxide, the resulting mixture was refluxed in 150 ml of tertiary butyl alcohol for 1 hour. Before getting cold, the mixture was filtered and the solvent was removed below reduced pressure to obtain a white solid product. Recrystallization with benzene gave 48.5 g (95% yield) of the title compound as white crystals. The compound thus obtained was found to have a melting point of 64°-65° C.

SYNTHESIS EXAMPLE 3

Preparation of exemplified compound (II - 3)

To a pressure bottle charged with 30 cc of isopropyl alcohol were added 2.6 g of butadiene oxide, 3.6 g of N,N-dimethylhydrazine and 14.5 g of $C_3F_7COOC_2H_5$, and the bottle was sealed and then allowed to stand at room temperature for 5 days. After completion of the reaction, the solvent was removed under reduced pressure, and after boiling in benzene, the reaction liquid was crystallized by cooling to obtain 16.7 g (92% yield) of the title compound as yellowish white crystals, m.p. 125°-127° C.

In the surface active agents used in the present invention, the number of fluorine atoms attached to carbon atoms is preferably less than 40. This is because, the surface active agent becomes less soluble in organic solvents with increase in number of fluorine atoms and consequently usable solvents are limited and, further a pressing necessity for using organic solvents high in toxicity arises in point of solubility.

The resins used in the present invention into which such surface active agents are to be incorporated include, for example, the below-mentioned polymer resins and homopolymers, blend polymers and copolymers thereof. The usable resins include acrylic resins, e.g. ethyl acrylate-glycolacrylic acid-styrene terpolymers, vinyl toluene-diethylaminoethyl methacrylate-ethyl acrylate terpolymers, styrene-2-vinylpyridine-ethyl acrylate terpolymers, ethyl acrylate-styrene copolymers, styrene-N-vinylcarbazole-ethyl acrylate terpolymers, etc.; celluloss ester resins such as nitrocellulose, etc.; allyl ester resins such as polydimethyldiallyl ammonium chloride, etc.; vinylbenzyltrimethyl ammonium chloride resins; chlorinated rubber; polyolefins such as polyethylene, polypropylene, etc.; polyurethanes; vinyl ester resins such as polyvinyl chloride, polyvinylbutyral, polyvinyl vhloride acetate, etc.; styrene resins; epoxy resins; and olefin resins such as ethylenebutadiene copolymers, etc.

Usable as core particles for the carrier in the present invention are, for example, particles of metals such as magnetic iron and steel, copper, bronze, nickel, etc., ferrite particles, carborundum particles, glass particles, silicon dioxide particles and the like particles. A particle diameter of the core particle is normally 50 to 1000 μm, preferably 50 to 500 μm.

On the surfaces of the core particles mentioned above is coated a coating material comprising the aforesaid resins, either singly or a mixture of two or more, having incorporated therein one or two or more of the surface active agents mentioned previously, and thereby to form coating layers on the core particle surfaces. The proportion in the aforesaid coating material of the surface active agent to the resin is normally 0.1 to 60% by weight, preferably 0.5 to 25% by weight.

A thickness of the aforesaid coating layer normally ranges from 0.1 to 30 microns, preferably from 0.2 to 20 microns.

In forming the aforesaid coating layer, the aforesaid resin and surface active agent are dissolved in a suitable solvent, for example, alcohols such as methanol, ethanol, isopropanol, etc., ketones such as acetone, methyl ethyl ketone, methylisobutyl ketone, etc., aromatic compounds such as toluene, xylene, etc., other organic solvents such as tetrahydrofuran, dioxane, etc. or mixtures thereof to prepare a solution of coating materials, and the solution is coated by suitable means on the aforesaid core particles of the carrier and then dried by evaporating the solvent at a temperature necessary therefor to volatilize. For coating the solution of coating materials on the core particles, the fluidized bed technique is particularly preferable, though the dipping method or spray method may be adopted.

In this fluidized bed technique, the pressure of the gas stream lifts the core particles to an equilibrium height, at which height, the particles are subjected to a downward spray before descending. This operation is repeated until a coat of the desired thickness is formed on the core particle surfaces. In this way, the core particles receive a homogeneous coating.

Furthermore, it is also possible that an intermediate layer consisting of a resin is coated on the surface of core particle without providing the core particle with the aforesaid coating layer; but is then coated on the thus formed intermediate layer the said coating layer containing the aforesaid surface active agent. The resin that constitutes the above-mentioned intermediate layer is the same as in the aforesaid coating layer, and the thickness thereof is preferably in the range of from 0.01 to 20 microns. By virtue of providing such intermediate layer, not only the adhesion between the coating layer and the core particle can be much increased but also the mechanical strength of the carrier particle can be made stronger. When this intermediate layer is relatively thick, the aforesaid coating layer may sometimes be smaller than usual. Furthermore, it is also possible to incorporate a small amount of the surface active agent, if necessary, into the resin constituting this intermediate layer and thereby to improve the intermediate layer in affinity for the coating layer.

The process for perparing the above-mentioned carriers according to the present invention is stated as follows. The resin and surface active agent are dissolved in an appropriate solvent to prepare a solution, the resulting solution is coated on the surfaces of core particles of carrier, and the coated solution is then dried by evaporating the solvent at a temperature necessary to form coating layers on said surfaces. The solvent usable in the process of the present invention above includes those which are compatible with both the above-mentioned resins and surface active agents. In this fluidized bed technique, the core particles lifted by a rising pressure gas stream in the fluidized bed system to ascend to an equilibrium height, and the solution is downwardly sprayed over the lifted core particles before said particles come down again, followed by repeating this operation to form coatings of the desired thickness on the core particle surfaces. According to this procedure, each core particle can uniformly be coated on the surface with the coating solution.

According to the present invention as explained above, by virtue of the resin constituting the coating layer, the layer not only attaches with a large adhesion force to the core particle but also becomes mechanically strong by itself. Furthermore, this resin contains a fluorine-containing surface active agent and, because of its having a functional group with affinity for the resin, said surface active agent is sufficiently retained in the coating layer and does not fall off therefrom.

Still further, the surface agent has a carbon-fluorine bond which is repelled by a functional group in the aforesaid resin resulting in the fluorine atom being oriented outwards from the surface and the functional group of the resin inwards. The net effect is that there is a concentration gradient at the surface; the concentration of surface active agent decreases in going from the surface to the particle.

Consequently, the density of fluorine atoms at the surface portion of the said coating layer becomes higher than that of the inner portion. On this account, the carriers of the present invention has surely and sufficiently the property of preventing toner particles or the like from adhesion thereto and, at the same time, an excellent charge controllability. Such molecular orientation and concentration gradient as may be seen in the coating layer according to the procedure as already explained previously, which procedure involves steps of spraying the solution of coating material as aforesaid over the core particles of carrier, followed by drying so as to evaporate the solvent present in the coated layer.

The above fact that in the aforesaid coating layer the density of fluorine atoms is high at the surface portion of said layer has been experimentally confirmed. That is, in this experiment a solution of 1 g of an acrylic resin and 0.2 g of "Fluorad FC 134" [a product of Sumitomo 3M, consisting of a fluorine-contained surface active agent, i.e. exemplified compound (V-3)] in 20 ml of an acetone-methanol mixed solvent was coated on the surface of a polyethylene terephthalate substrate of 200μ in thickness so as to form a coating layer having a dry film thickness of 40μ, and then dried. Using an X-ray microanalysis apparatus, the thus coated layer was measured in characteristic X-ray (Kα ray of fluorine atom) spectrum in the direction of thickness of said layer to obtain the results as shown in the accompanying drawing, wherein 1 represents a substrate and 2 represents a coated layer. It is clear from this spectrum that in the coated layer 2 which corresponds to the coating layer of the present carrier, a concentration of fluorine atoms is markedly high in the surface portion of said layer.

As explained above, the carriers of the present invention, in which the coating layer securely attaches to core particle thereof and its surface energy is quite small, are prevented when used as developers from adhesion thereto of toner particles and, consequently, no film resulting from the toner particles that usually tend to attach to the surface of said coating layer is formed. Simultaneously, because its friction force is lessened to an appropriate extent, the coating layer is not subject to wear, rupture or peeling-off from the core particle, and because no change due to adhesion of foreign matter in surface characteristics thereof is brought, the present carriers are stable without losing their excellent triboelectric charge characteristics even when used for a long period of time. Thus, the present carriers are always able to achieve their action as expected and come to have a long life. On account of the foregoing, when an electrostatic latent image is developed with a developer consisting of the present carrier and a toner, the carrier can surely impart over a long period of time to the toner particles an electric charge having any magnitude and polarity as desired and form a number of excellent copies of the image free from fog.

Usable as toners, which constitute together with the carriers of the present invention as explained hereinbefore a developer, are those prepared by incorporating suitable pigments or dyes into resins. The pigments or dyes suitably usable in that case include, for example, Carbon black, Nigrosine dyes, Aniline blue, Calcooil blue, Chrome yellow, Ultramarine blue, Methylene blue-chloride, Phthalocyanine blue, Rose Bengale and mixtures thereof. Typical of the usable resin are styrene resins, and the styrene resins include homopolymer of styrene and copolymers of styrene and other vinyl monomers. Usable vinyl monomers include p-chlorostyrene, vinyl naphthalene, ethylenically unsaturated monoolefins, e. g. ethylene. propylene, butylene, isobutylene, etc., vinyl esters, e.g. vinyl chloride, vinyl bromide, vinyl fluoride, vinyl acetate, etc., $\alpha$-methylene aliphatic carboxylic acid esters, e.g. methyl acrylate, ethyl acrylate, phenyl acrylate, etc., acrylonitrile, methacrylonitrile, acrylamide, vinyl ethers, e.g. vinyl methyl ether, vinyl ethyl ether, etc., vinyl ketones, e.g. vinyl methyl ketone, vinyl hexyl ketone, etc., and one or two or more vinyl compounds, e.g. N-vinyl pyrol, N-vinyl pyrrolidone, etc. In addition to the styrene resins, usable resins are vinyl ester resins, rosin-modified phenol formalin resins, epoxy resins, polyurethane resins, cellulose resins, polyether resins and mixtures thereof.

The present invention is illustrated below with reference to examples.

EXAMPLE 1

In 300 ml of methyl ethyl ketone were dissolved with stirring 20 g of an acrylic resin (a product of Mitsubishi Rayon K.K.) and 2 g of a surface active agent consisting of exemplified compound (I-1) to prepare a solution of coating materials. Using a fluidized bed apparatus, the solution was sprayed over 1 Kg of spherical steel shots (an average particle diameter being 100$\mu$) used as core particles to form coating layers on the core particle surfaces, followed by drying. The thus prepared carrier did not substantially agglomerate. A developer was prepared by mixing the carrier with a toner consisting of a styrene-acrylic ester copolymer and carbon black and containing no charge control agent. The toner thus prepared was subjected to test development of an electrostatic latent image in an electrophotographic copying machine.

As a result of the above test development, there were obtained copies of the image excellent in image quality and less in background; more than 50000 usable copies were obtained in a high speed endurance test.

In contrast thereto, a developer comprising a carrier prepared in the same manner as above but using no surface active agent was subjected to test development under the same conditions as above, whereupon favorable copies of the image were obtained only before termination of copying the 1000th copy.

EXAMPLE 2

A carrier according to the present invention was prepared in the same manner as in Example 1 except that exemplified compound (II-3) was used as the surface active agent, and a developer comprising the thus prepared carrier was subjected to the same test as in Example 1, whereupon copies of the image excellent in image quality and less in background were obtained over more than 50000 times of copying.

EXAMPLE 3

A carrier according to the present invention was prepared in the same manner as in Example 1 except that exemplified compound (III-1) was used as the surface active agent. Using a developer comprising the thus prepared carrier in the same test as in Example 1, the results similar to those of Example 1 were obtained.

EXAMPLE 4

A carrier according to the present invention was prepared in the same manner as in Example 1 except that exemplified compound (IV-1) was used as the surface active agent. As a result of the use of a developer comprising the thus prepared carrier in the same test as in Example 1, there were obtained the results similar to those of Example 1.

EXAMPLE 5

A carrier according to the present invention was prepared in the same manner as in Example 1 except that exemplified compound (V-1) was used as the surface active agent. A developer comprising the thus prepared carrier was used in the same test as in Example 1 to obtain the results similar to those of Example 1.

EXAMPLE 6

In 700 ml of acetone was dissolved 20 g of a styrenebutadiene copolymer and 5 g of the aforementioned exemplified compound (IV-1) to prepare a solution of coating materials. On the other hand, iach particle of 1 Kg of the same spherical steel shots as in Example 1 was coated with an acrylic resin to form an intermediate layer of 2 to 3$\mu$ in thickness, and the steel shot particles thus coated were intended to be used as core particles for carrier. The solution of coating materials prepared above was sprayed in the same manner as in Example 1 over the core particles to prepare a carrier according to the present invention. A developer was prepared in the same manner as in Example 1 using the carrier prepared above. The developer was used in the same test as in Example 1, whereupon copies of the image were all found excellent in image quality and free from fog, and more than 100000 times of copying were successfully possible in a high speed endurance test.

EXAMPLE 7

A solution of coating materials was prepared by dissolving in 200 ml of methyl ethyl ketone 20 g of an acrylic resin (a product of Mitsubishi Rayon K.K.) and 2 g of a fluorine-contained surface active agent ("Fluorad FC-134," a product of Sumitomo 3M) consisting of exemplified compound (V-3). Using a fluidized bed apparatus, the thus prepared solution was sprayed over 1 Kg of spherical steel shots having an average particle diameter of 100μ and then dried to prepare a carrier of the present invention, each core particle of which had a coated layer of 3 to 4μ in thickness. The carrier thus prepared was mixed with a toner consisting of a resin and carbon black to prepare a developer containing 5% by weight of the carrier, and this developer was subjected to test for electrostatic latent image development in an electrophotographic copying machine. As the result, copies of the image obtained thereby were all found excellent in image quality and able to withstand copying of more than 50,000 times in a high speed endurance test.

EXAMPLE 8

A solution of coating materials was prepared by dissolving in 800 ml of methyl ethyl ketone, 30 g of a vinyl chloridevinyl acetate copolymer and 5 g of perfluorooctanoic acid ($C_7F_{15}COOH$). Using the solution thus prepared, a carrier of the present invention was prepared, each core particle of which had a coated layer of 5 to 6μ in thickness, in the same manner as in Example 6. Using this carrier, a developer was prepared in the same manner as in Example 6, and the same test as in Example 6 was conducted using the developer. As the result, copies of the image obtained were all found excellent in image quality and free from fog formation, and were also found to be able to withstand copying of more than 50,000 times in a high speed endurance test.

COMPARATIVE EXAMPLE 1

Only the surface active agent used in Example 1 was dissolved in methyl ethyl ketone to prepare a solution. In the same manner as in Example 1, the thus prepared solution was sprayed over the spherical steel shots to prepare a carrier, and a developer comprising the thus prepared carrier was used in the same test as in Example 1. As a result, it was found that fog was formed on the resulting copies of the image at the time when the number of copying operations exceeded 20 times, and no practically usable copies of the image were obtained when the number of operations exceeded 100 times, because the image density excessively decreased.

COMPARATIVE EXAMPLE 2

Using a fluidized bed apparatus, each particle of 1 Kg of the same spherical steel shots as in Example 1 was coated with an acrylic resin to form an intermediate layer of 5μ on the particle surface, and further a 5% methyl ethyl Ketone solution of only the surface active agent used in Example 1 was coated on the surface of the intermediate layer formed above to prepare a carrier. A developer comprising the carrier thus prepared was used in the same test as in Example 1, whereupon formation of fog was observed in the resulting copies of the image at the time when the number of copying operations exceeded about 300 times.

What we claim is:

1. A developer carrier for electrophotography comprising a plurality of core particles, said particles coated with a layer comprising a resin and a surface active agent incorporated therein, said agent containing at least one carbon-fluorine bond and having at least one functional group having an affinity for said resin.

2. A developer carrier according to claim 1 wherein the functional group is selected from the group consisting of —COOR, —OR, —NCO, $—N(R)_2$, $—N^+(R)_3$, $—CON(R)_2$, —SR, $—OSO_3R$ and $—SO_3R$ (wherein R represents a hydrogen, an alkyl group, an aryl group, an aralkyl group, an alkaryl group, a heterocyclic ring, an alkenyl group or salt of derivative of these group).

3. A developer carrier according to claim 2 wherein the surface active agent represented by the following general formula [I], [II], [III], [IV] or [V]:

General formula [I]

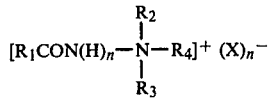

General formula [II]

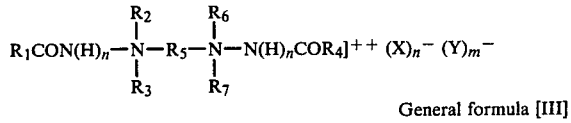

General formula [III]

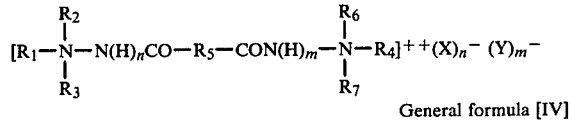

General formula [IV]

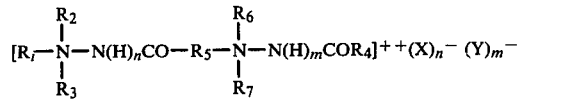

wherein $R_1$ and $R_4$ represent an alkyl group, an aralkyl group, an aryl group, a heterocyclic ring or a group derived therefrom, and at least one of $R_1$ and $R_4$ represent said group or ring, of which the whole or a part of a hydrogen has been substituted by a fluorine; $R_2$, $R_3$, $R_6$ and $R_7$ each represent a lower alkyl group; $R_5$ represents a divalent group; $(X)^-$ and $(Y)^-$ each represent an anion; and m and n each represent 0 or 1.

General formula [V]

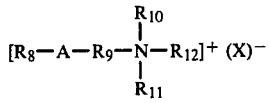

wherein $R_8$ represents a group having at least 3 carbon atoms and at least 3 fluorine atoms attached to the carbon atoms; A represents a divelent atom or a divalent group; $R_9$ represents a divalent hydrocarbon group; $R_{10}$, $R_{11}$ and $R_{12}$ represent individually an alkyl group having 1-6 carbon atoms, an aryl group or an aralkyl group; and $(X)^-$ represents an anion; and $R_{10}$ and $R_{12}$, or $R_{10}$, $R_{11}$ and $R_{12}$ can be form a 5- or 6-membered nitrogen-containing heterocylic ring together with nitrogen.

4. A developer carrier according to claim 3 wherein the divalent group for $R_5$ represents an alkylene group, an arylene group, an alkenylene group, an alkyleneoxyalkylene group, a polyoxyalkylene group or a divalent group combined with at least one of an alkylene group and at least one of an arylene group.

5. A developer carrier according to claim 3 wherein the divalent atom or the divalent group for A represents —O—, —S—, —NR'—, —$SO_2$NR'—, —CONR'—, —NR'$SO_2$—, —NR'CO—, —$SO_3$—, —$OSO_3$—, —CO—, —COO— or —OCO— (wherein R' represents an alkyl group or an aryl group).

6. A developer carrier according to claim 3 wherein the divalent hydrocarbon group for $R_9$ represents an alkylene group, an alkenylene group, an arylene group, an aralkylene group, an alkarylene group, an oxyalkyrene group, an oxyarylene group or a polyoxyalkyrene group.

7. A developer carrier according to claim 1 wherein the number of the carbon-fluorine bonds in the surface active agent is 1-40.

8. A developer carrier according to claim 1 wherein the proportion of the surface active agent to the resin contained in the coating layer is 0.1-60 weight %.

9. A developer carrier according to claim 1 wherein a thickness of the coating layer is 0.1-30 microns.

10. A developer carrier according to claim 9 wherein a thickness of the coating layer is 0.2-20 microns.

11. A developer carrier according to claim 1 wherein the resin is selected from the group consisting of an acrylic resins, a styrene resins, an epoxy resins, a urethane resins, a polyamide resins, a polyester resins, an acetal resins, a polycarbonate resins, a phenol resins, an olefine resins, a cellulose resins, a vinyl ester resins, a halogenated vinyl resins, a vinyl chloride-vinyl acetate resins, a halogenated rubbers, a polyolefins and blend resin thereof.

12. A developer carrier according to claim 1 wherein the core particle of the carrier is coated through an intermediate layer comprising of a resin with the coating layer.

13. A developer for electrophotography comprising a developer carrier and a toner, said developer carrier comprising a core particle of the carrier is coated with a coating layer comprising a resin and a surface active agent containing a carbon-fluorine bond, and said surface active agent have been incorporated into said resin.

14. A process for the preparation of a developer carrier for electrophotography having a plurality of core particles, said process comprising coating a layer on the surface of said particles by applying a solution comprising a resin and a surface active agent, said agent containing at least one carbonfluorine bond and having at least one functional group having an affinity for said resin.

15. A process according to claim 14 further comprising applying said solution to said surface, then drying said solution by evaporating the solvent forming said solution whereby a higher density of said agent is obtained at the outer surface of the layer than at the inner surface thereof.

* * * * *